US010404012B1

(12) United States Patent
Stoyanov

(10) Patent No.: US 10,404,012 B1
(45) Date of Patent: Sep. 3, 2019

(54) ELECTRICAL CONNECTOR WITH CONNECTOR POSITION ASSURANCE ELEMENT

(71) Applicant: TE CONNECTIVITY CORPORATION, Berwyn, PA (US)

(72) Inventor: Anton Stoyanov, Winston-Salem, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/958,035

(22) Filed: Apr. 20, 2018

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC ..... H01R 13/639; H01R 13/6272
USPC ..... 439/352
See application file for complete search history.

(56) References Cited

U.S. PATENT DOCUMENTS 4,708,413 A * 11/1987 Schroeder ..... H01R 13/6272 439/352
5,643,003 A * 7/1997 Myer ..... H01R 13/6272 439/352
5,681,178 A * 10/1997 Kunkle ..... H01R 13/641 439/352
5,775,930 A * 7/1998 Model ..... H01R 13/641 439/352
6,491,542 B1 * 12/2002 Zerebilov ..... H01R 13/4226 439/352
7,201,599 B2 * 4/2007 Holub ..... H01R 13/506 439/352
7,470,138 B1 * 12/2008 Chen ..... H01R 13/506 439/352
7,544,081 B2 * 6/2009 Lim ..... H01R 13/4361 439/352
7,682,181 B1 * 3/2010 Jones, Jr. ..... H01R 13/6272 439/352
7,909,638 B2 * 3/2011 Seo ..... H01R 13/6272 439/352
8,678,846 B2 * 3/2014 Hitchcock ..... H01R 13/6272 439/352
8,747,146 B2 * 6/2014 Brown ..... H01R 13/641 439/489
8,926,355 B2 * 1/2015 Heil ..... H01R 13/641 439/352
9,281,619 B2 * 3/2016 Morello ..... H01R 13/6272
(Continued)

*Primary Examiner* — Abdullah A Riyami
*Assistant Examiner* — Vladimir Imas

(57) ABSTRACT

Electrical connector includes a housing and a connector position assurance (CPA) element mounted to the housing. The housing has a latch configured to secure a mating connector to the electrical connector. The CPA element includes a base and an arm extending therefrom. The CPA element is translatable relative to the housing between a pre-lock position and a lock position. As the CPA element is moved from the pre-lock position towards the lock position prior to the latch securing the mating connector, the arm of the CPA element engages the latch and deflects the latch away from a resting position with an increasing amount of deflection until the base of the CPA element abuts against a landing pad of the housing to block further movement of the CPA element towards the lock position.

20 Claims, 6 Drawing Sheets

(56) References Cited

U.S. PATENT DOCUMENTS

| | | | | |
|---|---|---|---|---|
| 9,680,256 | B1 | 6/2017 | Lane et al. | |
| 9,705,228 | B2 * | 7/2017 | Caldwell | H01R 13/4365 |
| 9,935,396 | B2 * | 4/2018 | Endo | H01R 13/6271 |
| 9,979,131 | B2 * | 5/2018 | Venkatesan | H01R 13/639 |
| 10,038,278 | B2 * | 7/2018 | Lane | H01R 13/6272 |
| 10,096,928 | B2 * | 10/2018 | Shimizu | H01R 13/4361 |

* cited by examiner

ELECTRICAL CONNECTOR WITH CONNECTOR POSITION ASSURANCE ELEMENT

BACKGROUND

The subject matter herein relates generally to electrical connectors that provide connector position assurance.

Some electrical connectors have latching features that are configured to releasably secure the electrical connector to a mating electrical connector to withstand pull-out forces that would pull the connectors apart and break an electrically conductive pathway therebetween. When mating two connectors, it may be difficult for an operator to ascertain whether the two connectors are fully mated such that the complementary latching features are properly engaged due to small physical sizes of the connectors and/or the presence of other components that obstruct the view and accessibility of the connectors. Some connector systems utilize connector position assurance (CPA) members that are designed as a means for ensuring that the connectors are properly and fully mated.

Some CPA members are movable between a pre-lock and a lock position. The CPA members may be designed to only be movable from the pre-lock position to the lock in response to the two mating electrical connectors reaching fully mated positions relative to one another. The CPA member may be restricted from moving to the lock position prematurely. As a result, when the CPA member is unrestricted and allowed to be moved by an operator to the lock position, this indicates to the operator that the connectors are fully mated.

However, some known CPA members are prone to malfunction by allowing the CPA members to prematurely and inadvertently move to the lock position before the connectors are fully mated. This premature actuation of the CPA members may be caused by forces exerted on the CPA member that overcome, overstress, and/or damage relatively weak stop features that are designed to block premature actuation of the CPA member. The forces may be exerted on the CPA member by an operator that accidentally pushes on the CPA member instead of a connector housing when mating two connectors, by external forces imparted on the CPA member during shipping and/or transit, or the like. The weakness of the stop features may be at least partially attributable to the general trend of reducing sizes of electrical connectors and components.

A need remains for an electrical connector having a CPA member that is able to withstand premature actuation of the CPA member from the pre-lock position to the lock position without damaging features on the connector.

BRIEF DESCRIPTION

In one or more embodiments of the present disclosure, an electrical connector is provided that includes a housing and a connector position assurance (CPA) element mounted to the housing. The housing includes a latch that is configured to secure a mating connector to the electrical connector. The CPA element includes a base and an arm extending from the base. The CPA element is translatable relative to the housing between a pre-lock position and a lock position. As the CPA element is moved from the pre-lock position towards the lock position prior to the latch securing the mating connector, the arm of the CPA element engages the latch and deflects the latch away from a resting position with an increasing amount of deflection until the base of the CPA element abuts against a landing pad of the housing to block further movement of the CPA element towards the lock position.

In one or more embodiments of the present disclosure, an electrical connector is provided that includes a housing and a connector position assurance (CPA) element mounted to the housing. The housing includes a latch configured to secure a mating connector to the electrical connector. The housing defines a cavity. The housing further includes a bridge extending across the latch. The latch is disposed between the bridge and the cavity. The bridge is spaced apart from the latch when the latch is in a resting position. The CPA element includes a base and an arm extending from the base. The CPA element is translatable relative to the housing between a pre-lock position and a lock position. As the CPA element is moved from the pre-lock position towards the lock position prior to the latch securing the mating connector, the arm of the CPA element engages the latch and deflects the latch away from the resting position towards the bridge with an increasing amount of deflection until the outer side of the latch engages the bridge to block further deflection of the latch.

In one or more embodiments of the present disclosure, an electrical connector is provided that includes a housing and a connector position assurance (CPA) element mounted to the housing. The housing includes a latch configured to secure a mating connector to the electrical connector. The housing further includes a bridge extending across the latch. The latch is disposed between the bridge and a cavity of the housing. The bridge is spaced apart from the latch when the latch is in a resting position. The CPA element includes a base and an arm extending from the base. The CPA element is translatable relative to the housing between a pre-lock position and a lock position. As the CPA element is moved from the pre-lock position towards the lock position prior to the latch securing the mating connector, the arm of the CPA element deflects the latch away from the resting position towards the bridge with an increasing amount of deflection until the latch engages the bridge to block further deflection of the latch, and until the base of the CPA element abuts against a landing pad of the housing to block further movement of the CPA element towards the lock position.

DETAILED DESCRIPTION

Embodiments of the present disclosure provide an electrical connector that includes a connector position assurance (CPA) element. The CPA element is moveable relative to a housing of the electrical connector. The CPA element is a mechanism designed to provide verification that the electrical connector is fully mated to a corresponding mating connector. The CPA element provides a sensory feedback (e.g., via sight, sound, and/or touch) to an operator or a robotic machine that mates the connectors. For example, after the mating connector is coupled to the housing of the electrical connector, the ability for unrestricted translation of the CPA element relative to the housing from a pre-lock to a lock position provides an indication or notification that the two connectors are fully mated.

In one or more embodiments described herein, the CPA element and the housing of the electrical connector are designed to provide various technical effects. One technical effect is the ability to prohibit, if not completely prevent, premature actuation of the CPA element from the pre-lock to the lock position when the electrical connector is not fully mated to a corresponding mating connector. For example, the electrical connector may be able to withstand actuation forces on the CPA element in excess of known standards and regulations without allowing the CPA element to prematurely move to the lock position. Another technical effect is the ability to prohibit, if not completely prevent, damage to features of the CPA element and/or the housing responsive to inadvertent forces exerted on the CPA element before the connectors are fully mated.

Figure 1:
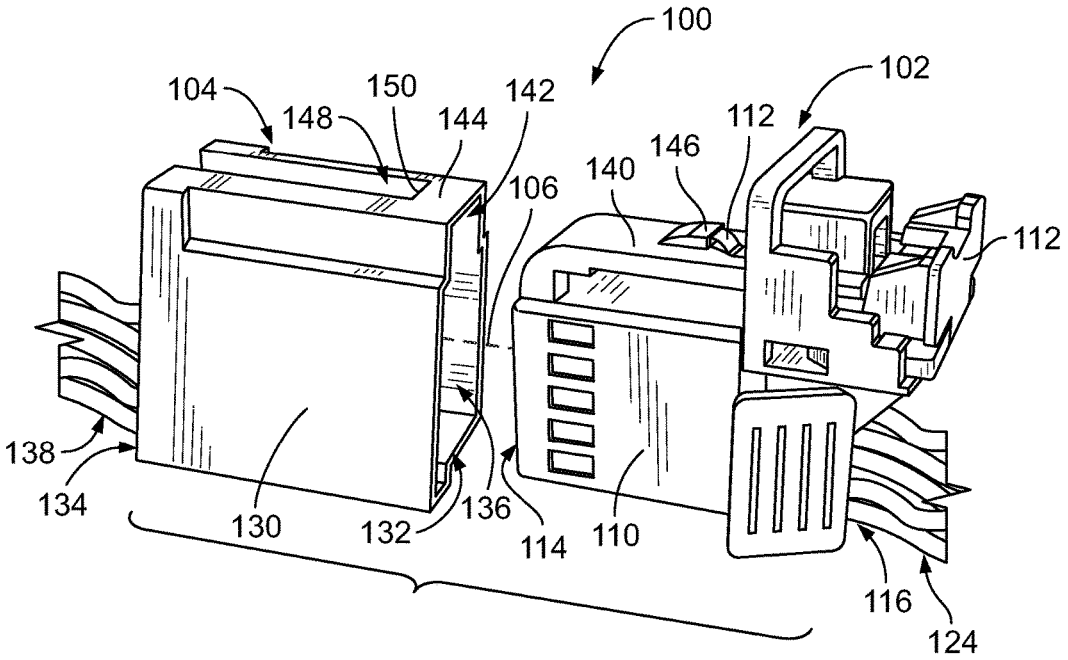
FIG. 1 is a perspective view of a connector system that includes a first electrical connector and a second electrical connector in accordance with an embodiment.
Figure 2:
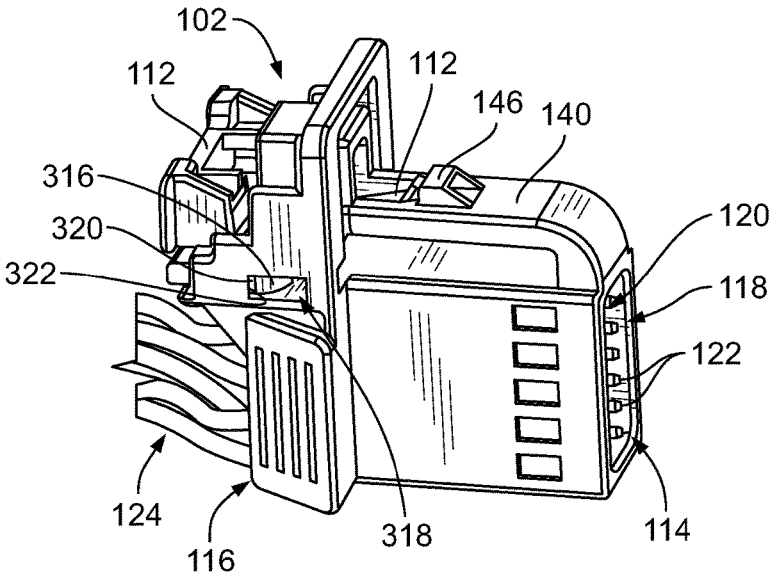
FIG. 2 is a front perspective view of the first electrical connector of the connector system.

FIG. 1 is a perspective view of a connector system 100 that includes a first electrical connector 102 and a second electrical connector 104 in accordance with an embodiment. The first and second electrical connectors 102, 104 are poised for mating along a mating axis 106. FIG. 2 is a front perspective view of the first electrical connector 102 of the connector system 100. The first electrical connector 102 includes a housing 110 and a CPA element 112 mounted to the housing 110. The first electrical connector 102 is referred to herein as "electrical connector", and the second electrical connector 104 is referred to herein as "mating electrical connector" and 'mating connector".

The housing 110 of the electrical connector 102 has a front end 114 and a back end 116 that is opposite the front end 114. The front end 114 defines a mating interface for engaging the mating connector 104 when coupled or "mated" to the mating connector 104. In the illustrated embodiment, the front end 114 of the housing 110 defines an opening 118 to a cavity 120. The electrical connector 102 holds multiple electrical contacts 122 within the cavity 120. The number, arrangement, and type of contacts 122 may vary depending on the type of connector 102 and the applied use of the connector 102. The electrical contacts 122 are configured to engage and electrically connect to electrical contacts (not shown) of the mating connector 104. In the illustrated embodiment, the electrical contacts 122 are terminated wires or cables 124 that project from the back end 116 of the housing 110.

The mating connector 104 has a housing 130 that holds the electrical contacts (not shown) of the mating connector 104. The housing 130 has a mating end 132 and a cable end 134. The mating end 132 defines a socket 136 that receives the front end 114 of the housing 110 when the connectors 102, 104 are mated. The mating connector 104 has wires or cables 138 that project from the cable end 134. In the illustrated embodiment, the housing 130 is linear such that the mating end 132 is opposite the cable end 134. In an alternative embodiment, the mating connector 104 may be mounted to a circuit board or device instead of terminated to the wires 138.

The housing 110 of the electrical connector 102 also includes a latch 140 that is used to secure the two connectors 102, 104 in the mated position. As the housing 110 is loaded into the socket 136 of the housing 130, the latch 140 is received into an upper channel 142 of the socket 136. The housing 130 includes a catch member 144 that engages the latch 140. For example, the latch 140 includes a tab 146 that projects outward from the latch 140. The tab 146 has a shark fin shape. As the housing 110 moves parallel to the mating axis 106, the catch member 144 engages the tab 146, causing the latch 140 to deflect towards the cavity 120. Continued movement of the housing 110 causes the tab 146 to move beyond the catch member 144 into a recess 148 of the housing 130. Once the tab 146 passes beyond an edge 150 of the catch member 144, the latch 140 resiliently returns towards an undeflected resting position, and the tab 146 extends into the recess 148. The latch 140 is shown in the resting position in FIGS. 1 and 2. The tab 146 within the recess 148 secures the mating connector 104 to the electrical connector 102 because pull-out forces exerted on the connectors 102, 104 causes the tab 146 to abut against the edge 150 of the catch member 144, blocking unintentional uncoupling of the connectors 102, 104. The connectors 102, 104 may attain the fully mated position upon the tab 146 entering the recess 148 beyond the catch member 144.

The CPA element 112 is mounted to the housing at or proximate to the back end 116. The CPA element 112 is movable relative to the housing 110 along the mating axis 106. The CPA element 112 is movable between a pre-lock position and a lock position. The CPA element 112 is shown in the pre-lock position in FIGS. 1 and 2. From the pre-lock position, the CPA element 112 is configured to move parallel to the mating axis 106 towards the front end 114 of the housing 110 such that the CPA element 112 is located closer to the front end 114 in the lock position than in the pre-lock position.

In embodiments described herein, the CPA element 112 is configured to only be movable from the pre-lock position to the lock position in response to the electrical connector 102 attaining a fully mated position relative to a corresponding mating connector (e.g., the mating connector 104). Thus, the CPA element 112 is restricted from moving from the pre-lock position to the lock position until the mating connector 104 is fully mated with the electrical connector 102. Upon attaching the fully mated position, the CPA element 112 is unrestricted and able to be moved to the lock position. The CPA element 112 may be moved by a human operator or a robotic machine that pushes or pulls the CPA element 112 in the direction towards the lock position. Once in the lock position, the CPA element can be selectively moved by the operator or machine back to the pre-lock position.

Figure 3:
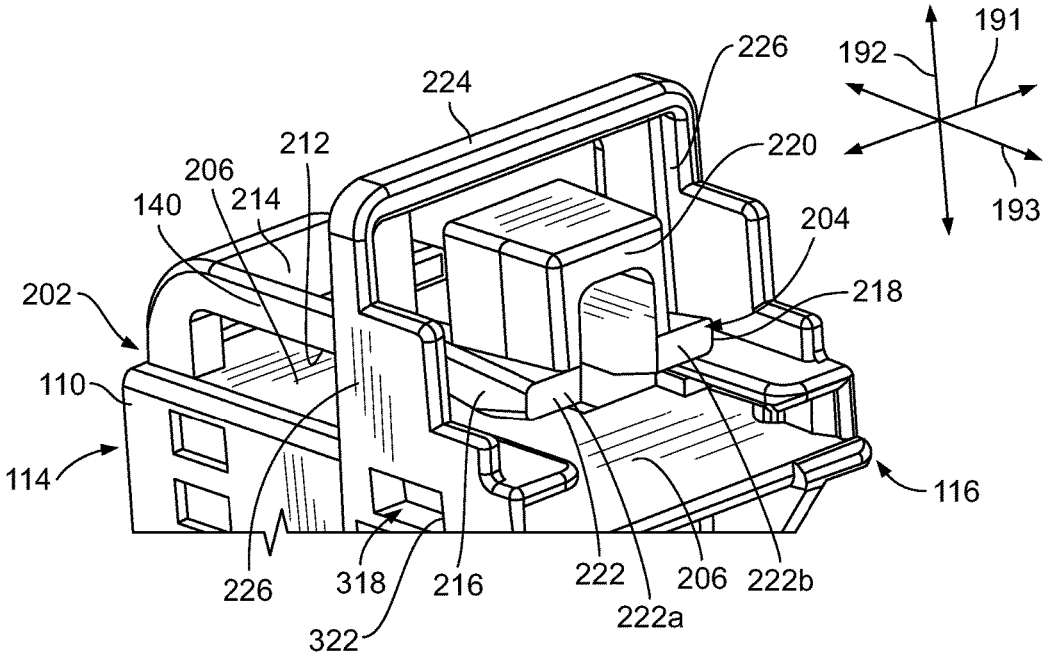
FIG. 3 is rear perspective view of a portion of the housing of the first electrical connector according to an embodiment.

FIG. 3 is rear perspective view of a portion of the housing 110 of the electrical connector 102 according to an embodiment. The cavity 120 (shown in FIG. 2) of the housing 110 is not visible in FIG. 3. The housing 110 is oriented with respect to a lateral axis 191, a vertical axis 192, and a longitudinal axis 193. The axes 191-193 are mutually perpendicular. Although the vertical axis 192 appears to extend in a vertical direction parallel to gravity in FIG. 3, it is understood that the axes 191-193 are not required to have any particular orientation with respect to gravity.

The latch 140 is cantilevered to the housing 110. The latch 140 extends from a fixed end 202 in engagement with the housing 110 to a distal, free end 204 that is spaced apart from the housing 110. In the illustrated embodiment, the fixed end 202 is located at or proximate to the front end 114 of the housing 110, and the free end is located proximate to the back end 116. For example, the latch 140 may be elongated parallel to the longitudinal axis 193 of the housing 110 that extends from the front end 114 to the back end 116. The fixed end 202 of the latch 140 may be mounted to, and extends from, a platform 206 of the housing 110. The platform 206 is a flat or planar surface. The platform 206 is disposed between the cavity 120 and the latch 140. The latch 140 includes an inner side 212 that faces the platform 206 (and the cavity 120), and an outer side 214 that is opposite the inner side 212. The latch 140 includes first and second edge sides 216, 218 extending from the inner side 212 to the outer side 214. As used herein, relative or spatial terms such as "upper," "lower," "inner," "outer," "front," and "back" are only used to distinguish the referenced elements and do not necessarily require particular positions or orientations relative to gravity and/or the surrounding environment of the electrical connector 102.

The latch 140 optionally includes a raised button 220 at or proximate to the free end 114. The button 220 outwardly projects from the latch 140 in a direction away from the platform 206. The button 220 provides a contact object for an operator to engage with a finger or a tool to selectively deflect the latch 140. The operator may selectively deflect the latch 140 to uncouple the connector 102 from the mating connector 104 (FIG. 1).

The housing 110 has at least one landing pad 222 that is configured to abut against the CPA element 112 to block the CPA element 112 from prematurely moving to the lock position when the connector 102 is not fully mated and secured to the mating connector 104 (FIG. 1). In the illustrated embodiment, the at least one landing pad 222 is located at the distal, free end 204 of the latch 140. Because the at least one landing pad 222 is on the latch 140, the position of the at least one landing pad 222 relative to the platform 206 varies with deflection of the latch 140. In the illustrated embodiment, the latch 140 defines two landing pads 222*a*, 222*b*. The two landing pads 222*a*, 222*b* laterally project from the button 220 in opposite directions.

The housing 110 also includes a bridge 224. The bridge 224 laterally extends across the latch 140. The bridge 224 is fixed to and extends between two upright members 226 of the housing 110. The upright members 226 are disposed along the edge sides 216, 218 of the latch 140 without engaging the edge sides 216, 218. The upright members 226 optionally extend from the platform 206. The bridge 224 is spaced apart from the latch 140 when the latch 140 is in the resting position shown in FIG. 3, such that the bridge 224 is mechanically separate from and does not engage the latch 140 in the resting position. The outer side 214 of the latch 140 faces towards the bridge 224. The latch 140 is vertically disposed between the bridge 224 and the cavity 120 (FIG. 2). The bridge 224 may be longitudinally located proximate to the free end 204 of the latch 140. In the illustrated embodiment, the bridge 224 longitudinally aligns with the button 220, such that the bridge 224 extends over the button 220. As described in more detail herein, the bridge 224 is configured to prevent overstress of the latch 140 by mechanically blocking deflection of the latch 140 in a direction away from the platform 206 and the cavity 120.

Figure 4:
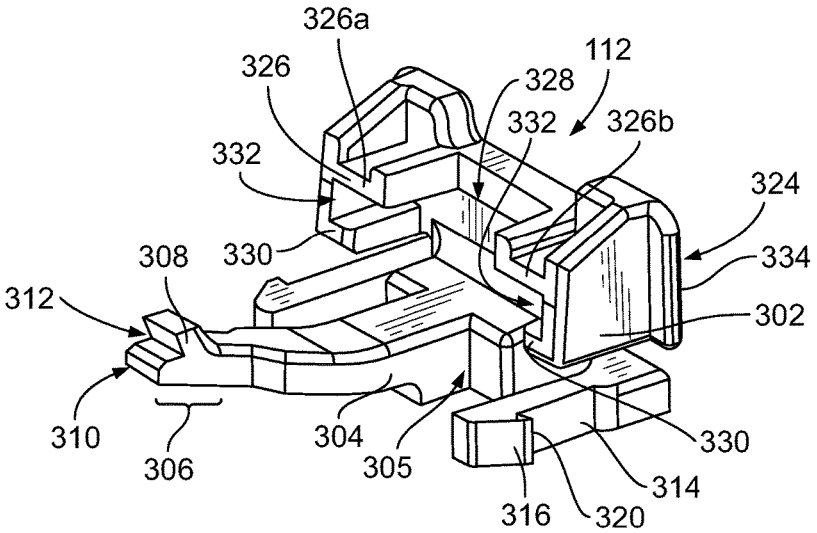
FIG. 4 is a perspective view of a CPA element of the first electrical connector according to an embodiment.

FIG. 4 is a perspective view of the CPA element 112 of the electrical connector 102 according to an embodiment. The CPA element 112 includes a base 302 and an arm 304 extending from the base 302. The arm 304 may be contoured or curved along at least a portion of the length of the arm 304. The arm 304 extends from a fixed end 305 at the base 302 to a distal tip 306 of the arm 304. The distal tip 306 includes a finger 308 projecting from the arm 304. The finger 308 is recessed from a distal end 310 of the arm 304 such that the distal tip 306 defines a notch 312 between the finger 308 and the distal end 310. The notch 312 is configured to accommodate a ledge 402 of the latch 140, which is shown in FIG. 5.

The base 302 includes two coupling latches 314 that secure the CPA element 112 onto the housing 110 (FIG. 3). The coupling latches 314 are disposed along opposite sides of the arm 304. The coupling latches 314 include hook features 316. The hook features 316 are received within corresponding apertures 318 in the housing 110, which are shown in FIGS. 2 and 3. The apertures 318 are elongated to allow the hook features 316 to move with the CPA element 112 relative to the housing 110 while remaining within the apertures 318. The hook features 316 have catch surfaces 320 that are configured to engage a back edge 322 of the corresponding aperture 318, as shown in FIGS. 2 and 3, to retain the CPA element 112 on the housing 110.

The base 302 includes an upright area 324 located vertically above the coupling latches 314. The upright area 324 includes at least one wing structure 326 that is configured to abut against the at least one landing pad 222 of the housing 110 (FIG. 3) to define a hard stop interface when the CPA element 112 is prematurely moved towards the lock position (e.g., while the electrical connector 102 is not secured to the mating connector 104). The upright area 324 of the base 302 includes two wing structures 326*a*, 326*b* in the illustrated embodiment. The wing structures 326*a*, 326*b* are spaced apart from each other by a central void 328. The wing structures 326 may be laterally elongated and oriented parallel to each other. For example, the wing structures 326 may be vertically aligned with each other (e.g., at the same distance above the coupling latches 314). The wing structures 326 may have other shapes in other embodiments. The upright area 324 includes ribs 330 disposed vertically between the wing structures 326 and the coupling latches 314. The upright area 324 of the base 302 defines tracks 332 (e.g., slots) between the wing structures 326 and the ribs 330. The tracks 332 are longitudinally elongated towards a back surface 334 of the upright area 324.

Figure 5:
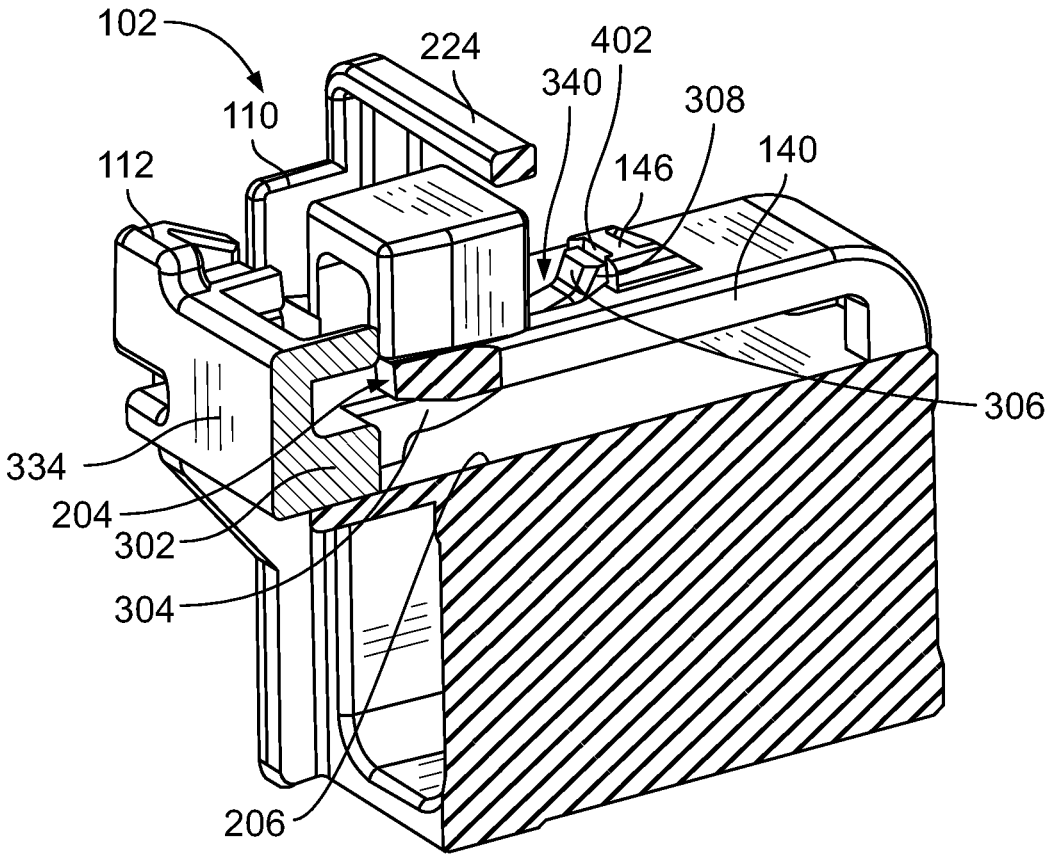
FIG. 5 is a cross-sectional back perspective view of the first electrical connector according to an embodiment.

FIG. 5 is a cross-sectional back perspective view of the electrical connector 102 according to an embodiment. The electrical contacts 122 and the wires 124 are omitted in FIG. 5. The CPA element 112 is mounted to the housing 110 in the pre-lock position. The latch 140 is in the resting position, which is an equilibrium position of the latch 140. The electrical connector 102 is not secured to the mating connector 104 (FIG. 1). When the CPA element 112 is in the pre-lock position and the latch 140 is in the resting position, the latch 140 is vertically spaced apart from the bridge 224. The CPA element 112 is designed to be slidable along the platform 206 of the housing 110 from the pre-lock position to the lock position responsive to the latch 140 securing to the mating connector 104.

The CPA element 112 extends at least partially under the latch 140. For example, a segment of the arm 304 proximate to the base 302 is disposed under the distal free end 204 of the latch 140. The arm 304 curves upward such that the distal tip 306 protrudes through a slot 340 in the latch 140. The finger 308 of the arm 304 engages the ledge 402 of the latch 140. In the illustrated embodiment, the ledge 402 is a back-facing edge of the shark fin tab 146. The ledge 402 nests into the notch 312 (shown in FIG. 4) of the arm 304.

In the illustrated embodiment, the back surface 334 of the base 302 is planar to provide a substantial contact area for an operator or machine to engage and actuate the CPA element 112 from the pre-lock position to the lock position. For example, an operator may push on the back surface 334 of the base 302 via one or more fingers of the operator, once the latch 140 is secured to the mating connector 104, to move the CPA element 112 to the lock position.

Figure 6:
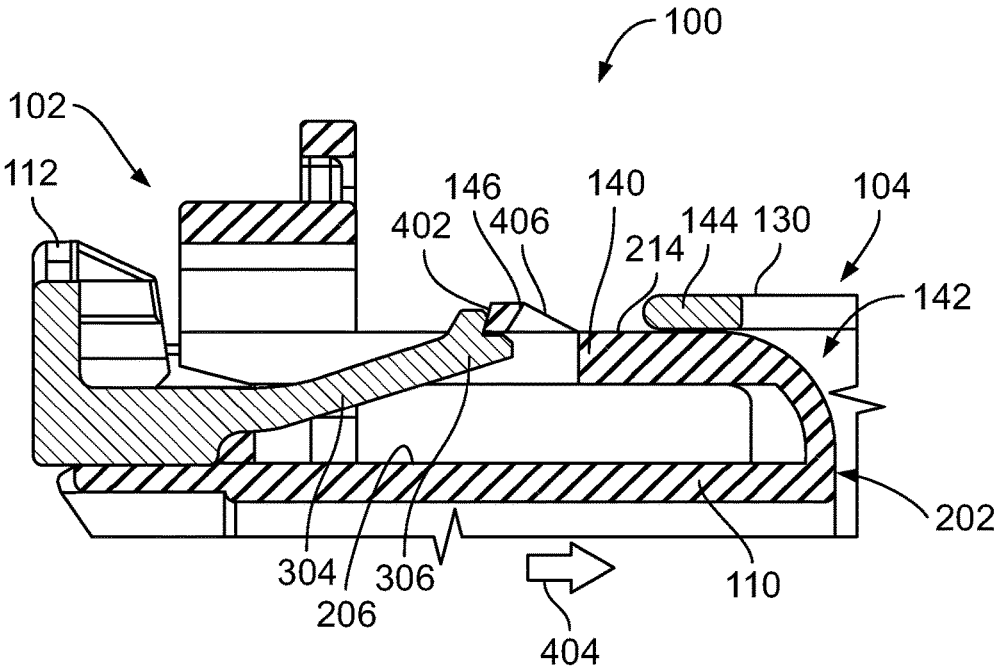
FIG. 6 is a cross-sectional view of a portion of the connector system at an intermediate mating position of the first and second connectors with the CPA element in a pre-lock position.
Figure 7:
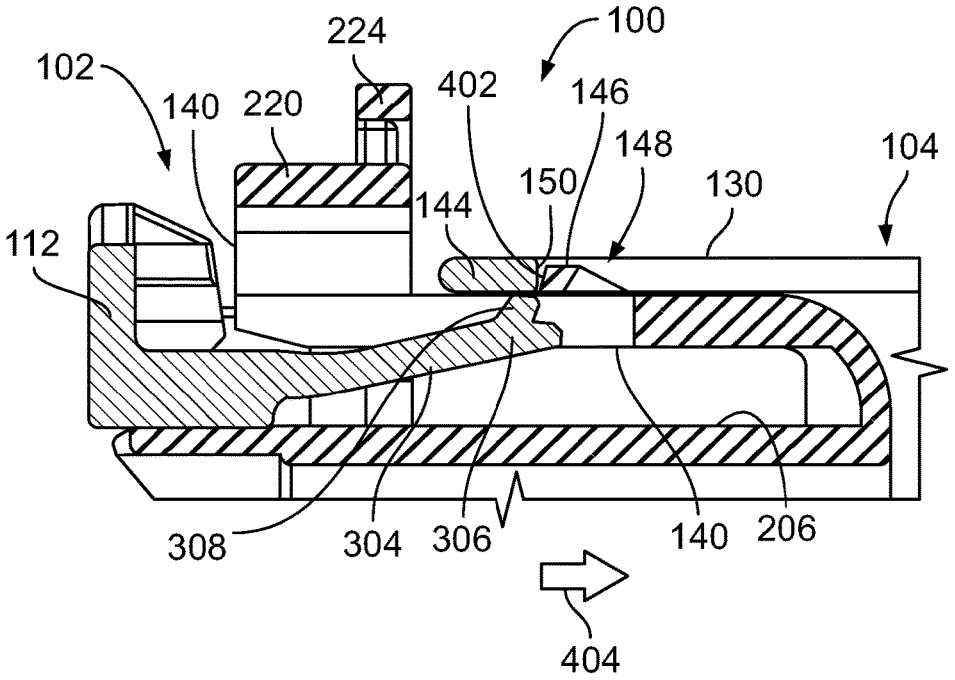
FIG. 7 is a cross-sectional view of a portion of the connector system at a fully mated position of the first and second connectors with the CPA element in the pre-lock position.
Figure 8:
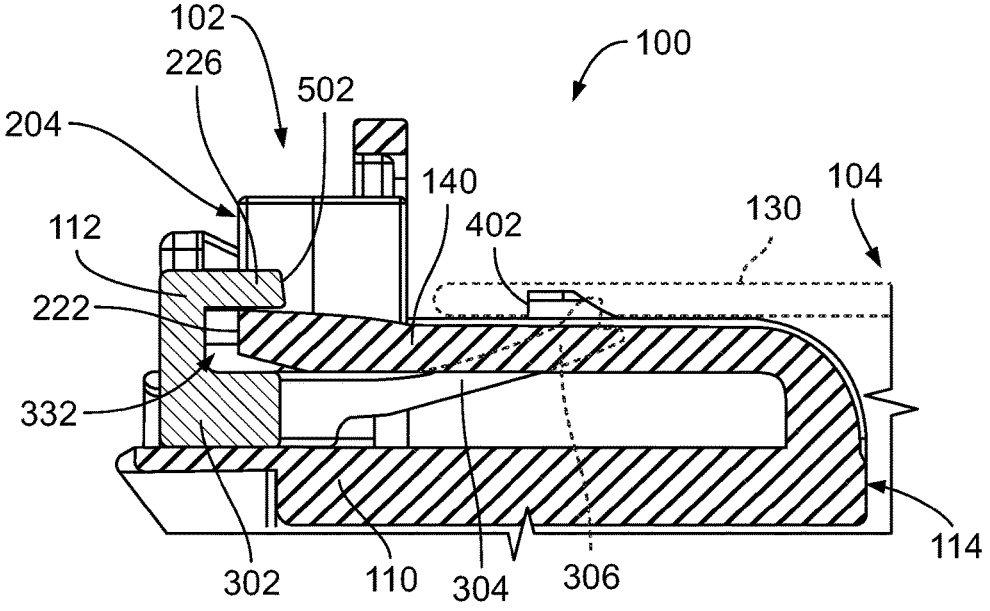
FIG. 8 is a cross-sectional view of a portion of the connector system at the fully mated position of the first and second connectors with the CPA element in the lock position.

FIGS. 6-8 illustrate a coupling mechanism for securing the mating connector 104 to the electrical connector 102 via the latch 140 and actuating the CPA element 112 to the lock position according to an embodiment. For example, FIG. 6 is a cross-sectional view of a portion of the connector system 100 at an intermediate mating position of the connectors 102, 104 with the CPA element 112 in the pre-lock position. The cross-section is taken along a longitudinal centerline. As the housing 110 of the electrical connector 102 is received into the socket 136 (FIG. 1) of the mating connector 104 in a loading direction 404 along the mating axis 106 (FIG. 1), the fixed end 202 of the latch 140 enters the upper channel 142 of the housing 130. The outer side 214 of the latch 140 moves along the catch member 144 of the housing 130. Eventually, the catch member 144 engages a ramp surface 406 of the shark fin tab 146 of the latch 140, which causes the latch 140 to deflect away from the resting position towards the platform 206 to allow for continued movement of the CPA element 112 in the loading direction 404. The deflection of the latch 140 also causes the arm 304 of the CPA element 112 to deflect via the engagement between the ledge 402 and the distal tip 306 of the arm 304.

FIG. 7 is a cross-sectional view of a portion of the connector system 100 at the fully mated position of the connectors 102, 104 with the CPA element 112 still in the pre-lock position. The cross-section in FIG. 7 is taken along the same longitudinal centerline as the cross-section in FIG. 6. Once the ledge 402 of the shark fin tab 146 moves in the loading direction 404 beyond the edge 150 of the catch member 144 of the housing 130, the tab 146 is allowed to move into the recess 148 of the housing 130, and the latch 140 resiliently returns towards the resting position. The latch 140 optionally may fully return to the resting position. The connectors 102, 104 are fully mated upon the tab 146 moving into the recess 148 adjacent to the catch member 144. The connectors 102, 104 are secured in the fully mated position because the ledge 402 of the tab 146 may abut against the edge 150 of the catch member 144 to withstand pull-out forces.

When the latch 140 secures the mating connector 104 as shown in FIG. 7, the catch member 144 is axially disposed between the tab 146 of the latch 140 and the button 220 of the latch 140. The catch member 144 prevents the arm 304 of the CPA element 112 from resiliently returning towards the resting position with the latch 140. As the latch 140 resiles towards the resting position, the distal tip 306 of the arm 304 disengages the ledge 402. The catch member 144 engages the finger 308 and forces the distal tip 306 to adopt a deflected position below the ledge 402 (e.g., between the ledge 402 and the platform 206). With the finger 308 below the ledge 402, the CPA element 112 is not restricted from moving from the pre-lock position to the lock position. The CPA element 112 moves in the loading direction 404 parallel to the mating axis 106 (FIG. 1) towards the lock position. The movement of the CPA element 112 towards the lock position does not cause the latch 140 to deflect when the latch 140 is secured to the mating connector 104. For example, the bridge 224 remains spaced apart from the button 220 of the latch 140.

FIG. 8 is a cross-sectional view of a portion of the connector system 100 at the fully mated position of the connectors 102, 104 with the CPA element 112 in the lock position relative to the housing 110. The cross-section in FIG. 8 is taken along a longitudinal line that is offset from the centerline shown in FIGS. 6 and 7. The housing 130 of the mating connector 104 is shown in phantom in FIG. 8. In the lock position, the CPA element 112 is located closer to the front end 114 of the housing 110 than in the pre-lock position. The distal tip 306 of the arm 304 is disposed beyond the ledge 402 of the latch 140, such that the distal tip 306 is axially located between the ledge 402 and the front end 114. As the CPA element 112 moves towards the lock position, the landing pads 222 at the distal free end 204 of the latch 140 are received into the tracks 332 of the base 302 of the CPA element 112. Only one of the landing pads 222 is visible in the illustrated cross-sectional view. The landing pads 222 are vertically spaced apart from (e.g., below) the corresponding wing structures 326 of the base 302 such that the landing pads 222 overlap and move beyond front surfaces 502 of the wing structures 326 without abutting against the front surfaces 502. When the latch 140 is in the resting position as shown in FIG. 8, translation of the CPA element 112 from the pre-lock position to the lock position causes the landing pads 222 of the latch 140 to be received into the tracks 332 without abutting against the wing structures 326 of the base 302.

Figure 9:
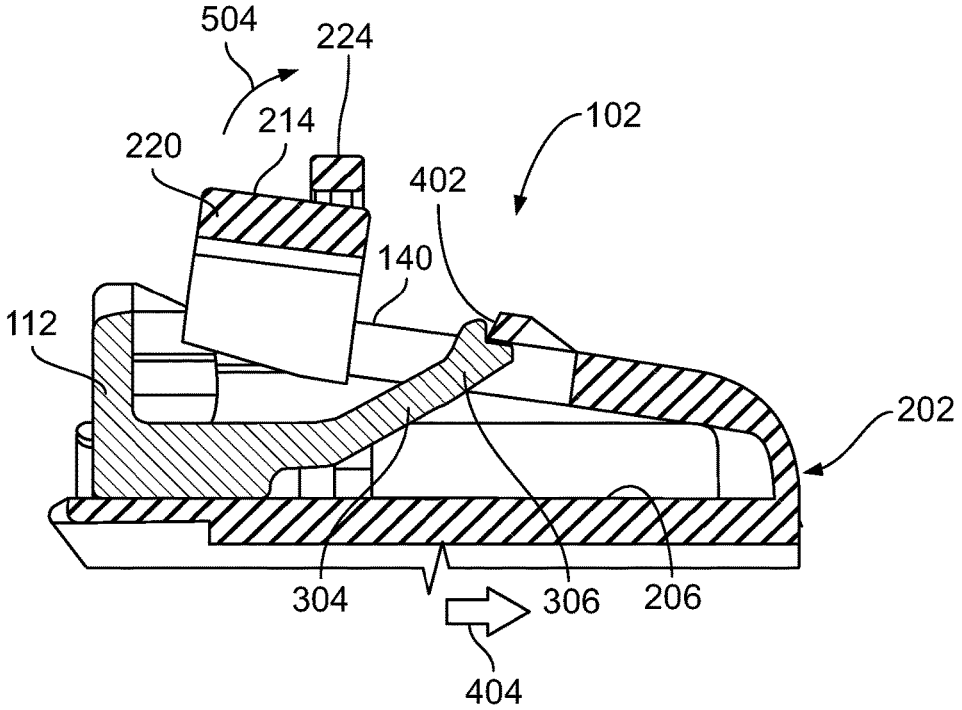
FIG. 9 is a cross-sectional view of a portion of the first electrical connector showing premature actuation of the CPA element towards the lock position according to an embodiment.

FIG. 9 is a cross-sectional view of a portion of the electrical connector 102 showing premature actuation of the CPA element 112 towards the lock position according to an embodiment. The CPA element 112 is prematurely actuated when the CPA element 112 is moved from the pre-lock position in the loading direction 404 without the electrical connector 102 being fully mated to the mating connector 104 (e.g., without the latch 140 being secured to the mating connector 104). This movement of the CPA element 112 may be inadvertent or accidental, and may occur during assembly, production, shipping, or the like. The distal tip 306 of the arm 304 remains engaged with the ledge 402 of the latch 140 as the CPA element 112 is moved towards the lock position, which causes both the arm 304 and the latch 140 to deflect from the respective resting positions. The latch 140 deflects in a direction 504 away from the platform 206 (and away from the cavity 120 shown in FIG. 2) about the fixed end 202 of the latch 140. The direction 504 of deflection is opposite to the direction that catch member 144 (shown in FIG. 7) of the mating connector 104 deflects the latch 140 during mating. The amount or extent of deflection of the latch 140 and the arm 304 may gradually increase with increasing distance moved by the CPA element 112 in the loading direction 404.

In known connectors with CPA devices, the forces exerted on the CPA device and the latch may overstress and irreversibly damage the components. For example, the components may bend to an extent that the components lose the resiliency to return fully to an initial resting position and/or one or more of the components may chip or shear off at contact interfaces.

In the illustrated embodiment, the bridge 224 blocks the latch 140 from deflecting to an extent that could irreversibly damage the latch 140. For example, as the arm 304 of the CPA element 112 forces the latch 140 to pivot in the direction 504, the latch 140 moves towards the bridge 224. Eventually, the outer side 214 of the latch 140 engages the bridge 224. In the illustrated embodiment, the button 220 is the portion of the latch 140 that engages the bridge 224, but in other embodiments other portions of the latch 140 may be configured to abut the bridge 224 prior to the latch 140 reaching a breaking point. The bridge 224 blocks further deflection of the latch 140. Once the bridge 224 engages the latch 140, at least some of the forces exerted on the latch 140 by the arm 304 of the CPA element 112 are transferred to the bridge 224 to reduce the amount of force withstood by the latch 140 along a pivot location that is at or proximate to the fixed end 202.

Figure 10:
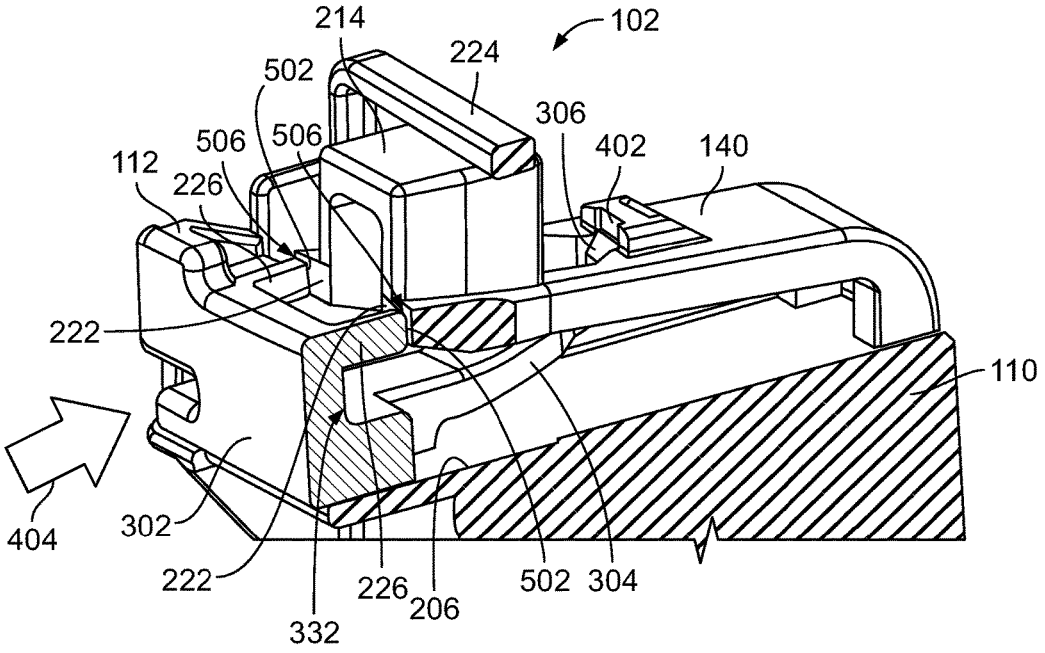
FIG. 10 is a cross-sectional back perspective view of a portion of the first electrical connector showing premature actuation of the CPA element towards the lock position.

FIG. 10 is a cross-sectional back perspective view of a portion of the electrical connector 102 showing premature actuation of the CPA element 112 towards the lock position according to an embodiment. The latch 140 is shown in a lifted position relative to the resting position due to the forces exerted on the ledge 402 by the distal tip 306 of the arm 304 of the CPA element 112. In the lifted position, the landing pads 222 of the latch 140 are raised a greater distance from the platform 206 than when the latch 140 is in the resting position, as shown in FIG. 5. In FIG. 10, the landing pads 222 vertically align with the wing structures 226 of the CPA element 112 (and no longer align with the tracks 332). Movement of the CPA element 112 in the loading direction 404 causes the front surfaces 502 of the wing structures 226 to abut against the corresponding landing pads 222, defining hard stop interfaces 506. The hard stop interfaces 506 block further premature movement of the CPA element 112 towards the lock position. Once in engagement, at least some of the forces exerted on the base 302 of the CPA element 112 in the loading direction 404 are transferred to the hard stop interfaces 506, which are better able to withstand the forces than the interface between the ledge 402 and the distal tip 306 of the arm 304.

In the illustrated embodiment, the wing structures 226 may abut against the landing pads 222 at a designated stop position of the CPA element 112 relevant to the housing 110. The designated stop position may be approximately the same position at which the outer side 214 of the latch 140 engages the bridge 224. The phrase "approximately the same position" user herein is intended to encompass the exact same position as well as a limited threshold distance from the exact same position, such as within 1 mm or 2 mm. For example, the electrical connector 102 may be designed such that the outer side 214 of the latch 140 engages the bridge 224 at an initial position, and then subsequent movement of the CPA element 112 in the loading direction 404 causes the wing structures 226 to abut the landing pads 222 at the designated stop position that is within the limited threshold distance of the initial position. In an embodiment, the initial position may be within 1 mm of the designated stop position.

In the illustrated embodiment, the outer side 214 of the latch 140 may engage the bridge 224 while the wing structures 226 concurrently engage the landing pads 222, providing three different contact interfaces in addition to the interface between the distal tip 306 of the arm 304 and the ledge 402. The contact interfaces prevent the CPA element 112 from prematurely reaching the lock position, and prevent irreversible damage to the components of the housing 110 and the CPA element 112 based on such premature movement of the CPA element 112. The electrical connector 102 may be able to withstand more than 80 N of force in the loading direction 404 to resist premature actuation of the CPA element 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing including a latch that is configured to secure a mating connector to the electrical connector; and a connector position assurance (CPA) element mounted to the housing, the CPA element including a base and an arm extending from the base, the CPA element translatable relative to the housing between a pre-lock position and a lock position, the CPA element mechanically secured to the housing in both the pre-lock and lock positions, wherein, as the CPA element is moved from the pre-lock position towards the lock position prior to the latch securing the mating connector, the arm of the CPA element engages the latch and deflects the latch away from a resting position with an increasing amount of deflection until the base of the CPA element abuts against a landing pad of the housing to block further movement of the CPA element towards the lock position.

2. The electrical connector of claim 1, wherein, upon the latch securing the mating connector, the arm of the CPA element does not deflect the latch away from the resting position as the CPA element is moved from the pre-lock position towards the lock position and the base of the CPA element does not abut against the landing pad of the housing.

3. The electrical connector of claim 1, wherein the landing pad of the housing is located at a distal free end of the latch.

4. The electrical connector of claim 1, wherein the landing pad of the housing is a first landing pad of two landing pads, wherein the CPA element includes two wing structures on the base, each of the two wing structures abutting a corresponding one of the two landing pads to define hard stop interfaces that block further movement of the CPA element towards the lock position while the latch is deflected by the arm of the CPA element.

5. The electrical connector of claim 1, wherein the CPA element includes a finger projecting from the arm along a distal tip of the arm, the finger configured to engage a ledge of the latch to deflect the latch as the CPA element is moved towards the lock position prior to the latch securing the mating connector.

6. The electrical connector of claim 1, wherein the CPA element is translatable from the pre-lock position to the lock position parallel to a mating axis along which the mating connector mates to the housing.

7. The electrical connector of claim 1, wherein the housing defines a cavity and holds electrical contacts within the cavity, wherein the arm of the CPA element deflects the latch in a direction away from the cavity as the CPA element is moved towards the lock position prior to the latch securing the mating connector.

8. The electrical connector of claim 7, wherein the latch has an inner side that faces the cavity and an outer side that is opposite the inner side, the housing further including a bridge extending across the latch and spaced apart from the outer side of the latch when the latch is in the resting position, wherein, responsive to the arm of the CPA element deflecting the latch, the outer side of the latch is configured to engage the bridge to block further deflection of the latch.

9. The electrical connector of claim 8, wherein the latch engages the bridge of the housing and the base of the CPA element abuts against the landing pad of the housing at approximately the same location of the CPA element relative to the housing between the pre-lock and lock positions.

10. The electrical connector claim 1, wherein the housing includes a front end and a back end that is opposite the front end, the front end defining a mating interface to engage the mating connector, wherein the CPA element is located closer to the front end when in the lock position than in the pre-lock position.

11. An electrical connector comprising:

a housing including a latch configured to secure a mating connector to the electrical connector, the housing defining a cavity, the housing further including a bridge extending across the latch, the latch disposed between the bridge and the cavity, the bridge spaced apart from the latch when the latch is in a resting position; and a connector position assurance (CPA) element mounted to the housing, the CPA element including a base and an arm extending from the base, the CPA element translatable relative to the housing between a pre-lock position and a lock position, wherein, as the CPA element is moved from the pre-lock position towards the lock position prior to the latch securing the mating connector, the arm of the CPA element engages the latch and deflects the latch away from the resting position towards the bridge with an increasing amount of deflection until the latch engages the bridge to block further deflection of the latch.

12. The electrical connector of claim 11, further comprising one or more electrical contacts held within the cavity of the housing for electrically connecting to the mating connector.

13. The electrical connector of claim 11, wherein the bridge is connected to and extends between two upright members located along opposite edge sides of the latch.

14. The electrical connector of claim 11, wherein, responsive to the arm of the CPA element deflecting the latch as the CPA element is moved towards the lock position prior to the latch securing the mating connector, the base of the CPA element abuts against a landing pad of the housing to block further movement of the CPA element towards the lock position.

15. The electrical connector of claim 14, wherein the latch engages the bridge of the housing and the base of the CPA element abuts against the landing pad of the housing at approximately the same location of the CPA element relative to the housing between the pre-lock and lock positions.

16. The electrical connector of claim 11, wherein, upon the latch securing the mating connector, the arm of the CPA element does not deflect the latch away from the resting position as the CPA element is moved from the pre-lock position towards the lock position such that the latch is spaced apart from the bridge.

17. An electrical connector comprising:

a housing including a latch configured to secure a mating connector to the electrical connector, the housing further including a bridge extending across the latch, the latch disposed between the bridge and a cavity of the housing, the bridge spaced apart from the latch when the latch is in a resting position; and a connector position assurance (CPA) element including a base and an arm extending from the base, the CPA element mounted to the housing and translatable relative to the housing between a pre-lock position and a lock position, wherein, as the CPA element is moved from the pre-lock position towards the lock position prior to the latch securing the mating connector, the arm of the CPA element deflects the latch away from the resting position towards the bridge with an increasing amount of deflection until the latch engages the bridge to block further deflection of the latch, and until the base of the CPA element abuts against a landing pad of the housing to block further movement of the CPA element towards the lock position.

18. The electrical connector of claim 17, wherein the CPA element includes a finger projecting from the arm along a distal tip of the arm, the finger configured to engage a ledge of the latch to deflect the latch as the CPA element is moved towards the lock position prior to the latch securing the mating connector.

19. The electrical connector of claim 18, wherein, upon the latch securing the mating connector, the mating connector forces the finger of the arm to disengage the ledge of the latch such that the arm does not deflect the latch away from the resting position as the CPA element is moved from the pre-lock position to the lock position.

20. The electrical connector of claim 17, wherein the latch defines the landing pad and, as the CPA element is moved towards the lock position, a wing structure of the base of the CPA aligns with the landing pad of the housing and abuts against the landing pad when the latch is deflected by the arm of the CPA element, wherein the wing structure does not align with the landing pad and does not abut the landing pad when the latch is in the resting position.

* * * * *